US009341458B2

(12) United States Patent
Rastegar et al.

(10) Patent No.: US 9,341,458 B2
(45) Date of Patent: May 17, 2016

(54) METHOD FOR PROVIDING ELECTRICAL ENERGY TO A SELF-DESTRUCT FUZE FOR SUBMUNITIONS CONTAINED IN A PROJECTILE

(71) Applicants: Jahangir S Rastegar, Stony Brook, NY (US); Richard T Murray, Patchogue, NY (US); Chris Janow, Picatinny, NJ (US); Richard Dratler, Barkmill Terrace, NJ (US)

(72) Inventors: Jahangir S Rastegar, Stony Brook, NY (US); Richard T Murray, Patchogue, NY (US); Chris Janow, Picatinny, NJ (US); Richard Dratler, Barkmill Terrace, NJ (US)

(73) Assignee: OMNITEK PARTNERS, LLC, Ronkonkoma, NY (US)

( * ) Notice: Subject to any disclaimer, the term of this patent is extended or adjusted under 35 U.S.C. 154(b) by 426 days.

(21) Appl. No.: 13/631,974

(22) Filed: Sep. 29, 2012

(65) Prior Publication Data

US 2015/0241188 A1 Aug. 27, 2015

Related U.S. Application Data

(62) Division of application No. 12/481,550, filed on Jun. 9, 2009, now Pat. No. 8,281,719.

(60) Provisional application No. 61/131,430, filed on Jun. 10, 2008.

(51) Int. Cl.

| | |
|---|---|
| ***F42C 9/16*** | (2006.01) |
| ***F42C 11/02*** | (2006.01) |
| ***F42C 15/44*** | (2006.01) |
| ***F42C 11/00*** | (2006.01) |

(52) U.S. Cl.
CPC ..... *F42C 11/008* (2013.01); *F42C 9/16* (2013.01); *F42C 11/02* (2013.01); *F42C 15/44* (2013.01)

(58) Field of Classification Search
CPC ..... F42C 11/00; F42C 11/02; F42C 11/008; F42C 11/06; F42C 9/00; F42C 9/02; F42C 9/04; F42C 9/048; F42C 9/14; F42C 9/16; F42C 11/001; F42C 15/44
USPC ..... 102/207–210
See application file for complete search history.

(56) References Cited

U.S. PATENT DOCUMENTS

| | | | | |
|---|---|---|---|---|
| 3,324,317 | A * | 6/1967 | Hazelet | 310/329 |
| 3,815,505 | A * | 6/1974 | Roh et al. | 102/210 |
| 3,850,102 | A * | 11/1974 | Morrow | 102/210 |
| 6,865,989 | B2 * | 3/2005 | Kolbli | 102/210 |
| 7,312,557 | B2 * | 12/2007 | Rastegar et al. | 310/339 |
| 7,506,586 | B1 * | 3/2009 | Pereira et al. | 102/207 |
| 7,762,191 | B2 * | 7/2010 | Rastegar et al. | 102/210 |
| 8,191,475 | B2 * | 6/2012 | Rastegar et al. | 102/210 |
| 8,205,555 | B1 * | 6/2012 | Rastegar et al. | 102/210 |
| 8,281,719 | B2 * | 10/2012 | Rastegar et al. | 102/210 |
| 8,408,133 | B2 * | 4/2013 | Rastegar et al. | 102/210 |
| 8,635,956 | B2 * | 1/2014 | Rastegar et al. | 102/210 |
| 8,820,209 | B2 * | 9/2014 | Rastegar et al. | 89/1.13 |
| 2006/0033406 | A1 * | 2/2006 | Rastegar et al. | 310/339 |
| 2006/0255690 | A1 * | 11/2006 | Rastegar et al. | 310/339 |

* cited by examiner

*Primary Examiner* — James S Bergin

(57) ABSTRACT

A method for providing electrical energy to a self-destruct fuze for submunitions contained in a projectile. The method including: using a firing acceleration of the projectile to deform at least one elastic element to store mechanical energy in the elastic element; converting the stored mechanical energy to electrical energy; and providing the electrical energy at least indirectly to the self destruct fuze for detonation of the self destruct fuze.

7 Claims, 3 Drawing Sheets

FIG. 1
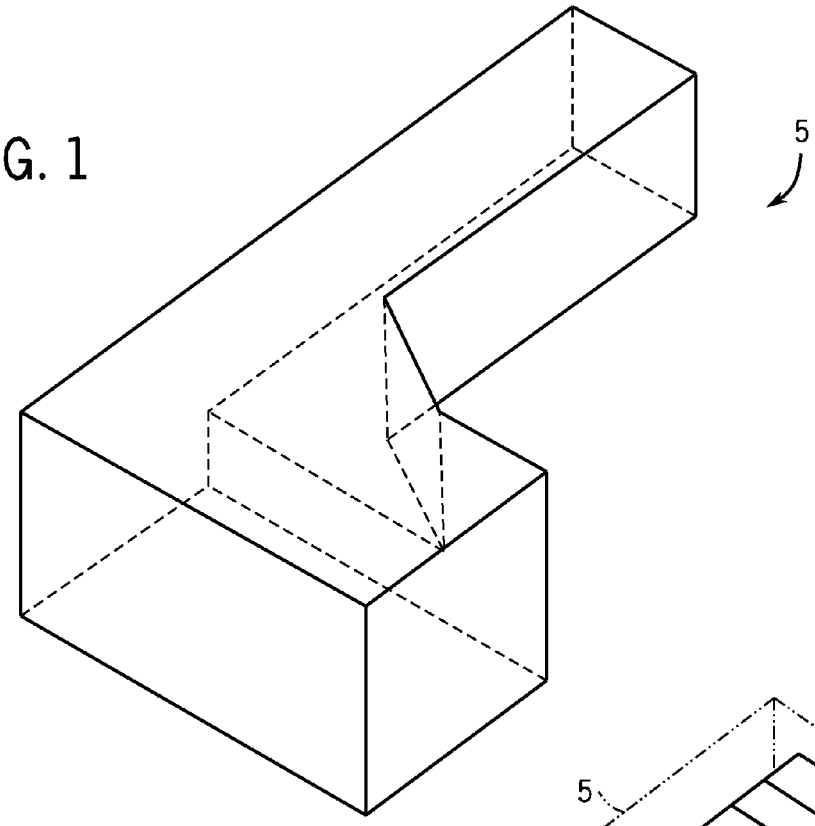
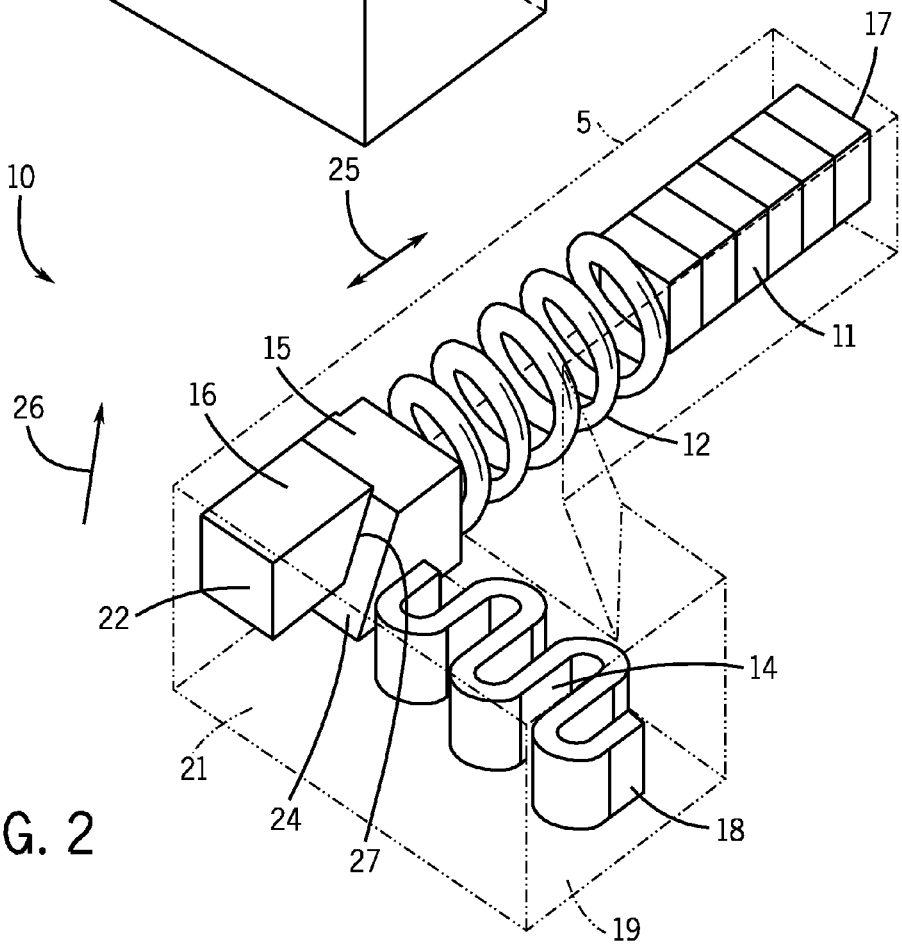
FIG. 2

METHOD FOR PROVIDING ELECTRICAL ENERGY TO A SELF-DESTRUCT FUZE FOR SUBMUNITIONS CONTAINED IN A PROJECTILE

CROSS-REFERENCE TO RELATED APPLICATIONS

This application is a Divisional Application of U.S. application Ser. No. 12/481,550 filed on Jun. 9, 2009, issuing as U.S. Pat. No. 8,281,719, which claims benefit to earlier filed provisional application Ser. No. 61/131,430 filed on Jun. 9, 2008, the entire contents of each of which are incorporated herein by reference.

GOVERNMENT RIGHTS

This invention was made with Government support under Agreement No. DAEE30-03-C-1077 awarded by the Department of Defense. The Government has certain rights in the invention.

FIELD

The present invention relates generally to power source and safety mechanisms for munitions, particularly an electrically operated self-destruct fuze for submunitions and the like.

BACKGROUND

Heavy guns such as artillery are sometimes used against foot soldiers, particularly where the target is out of range of machine gun bullets, or where there is no line of sight to the target. However, foot soldiers may be spread out over a large area and the damage caused by a conventional shell is too localized to be effective in such scenarios. One known approach for destroying foot soldiers under these conditions is to use a "cargo projectile" loaded with submunition grenades. The cargo projectile is a shell that is designed to be fired from large caliber cannons such as artilleries or tanks over the position of enemy foot soldiers. A plurality of submunition grenades are released and dispersed from the cargo projectile over a large area of ground. Such submunition grenades may be designed to explode in the air or may be designed to explode on impact.

The use of improved conventional munitions (ICMs) which can deliver a very large number of submunitions by means of an artillery or rocket carrier on a target area has increased the problem of hazardous duds that remain on the battlefield. The danger to follow-up friendly personnel has increased in recent time because of the large quantities of ICM carriers that have been deployed in each mission. Because of the large quantity of submunitions now deployed during each mission, all prior inputs have proven to still leave a prohibitive number of hazardous duds on the battlefield.

The basic requirements for submunition grenades include (i) a high degree of safety during storage and handling, both prior, during and subsequent to their being packed into cargo projectiles, (ii) reliability during deployment, i.e. that they should explode appropriately after release from the cargo projectile, and not prematurely, prior to their dispersal, (iii) the number of dangerous dud grenades that do not explode on impact should be minimized, and (iv) in certain cases, they should be prevented from explosion if they are dropped off the cargo projectile for any reason, before the projectile is fired. The minimization of dangerous duds is very important since if they are scattered over the battlefield, they would pose hazard to friendly troops and even to civilians or wildlife long after the battle. It will be appreciated that these requirements are to some extent contradictory, and the development of safe but highly explosive ordnance is not trivial.

Each submunition grenade includes a casing that disintegrates into lethal shrapnel when the submunition grenade explodes, a warhead for exploding the casing, and a fuze for detonating the warhead. To achieve the required safety levels in handling and storage, but reliability of the submunition grenade after releasing, the fuzes thereof are sophisticated devices that generally include chemical, mechanical and occasionally electrical subcomponents.

Typically the fuze of an impact type of submunition grenade includes a chemical detonator and a firing pin that triggers the detonator on impact. To allow the grenades and the cargo projectiles that contain such grenades to be handled safely, various safety mechanisms have been devised. Typically, in addition to the armed position in which is the grenade's fuze aligned to trigger the detonator, the firing pin of the submunition grenade also has a safe position, and when the firing pin is in this safe position, the submunition grenade can be handled and even dropped without fear of it detonating. However, once the firing pin is moved to the armed position however, an impact or similar jolt will cause the pin to detonate the detonator, igniting the warhead and thereby causing the submunition grenade to explode.

A known safety mechanism for submunition grenades is a slider assembly that keeps the detonator in a safe position away from the firing pin, preventing inadvertent detonation. After being detached from the cargo projectile, the centrifugal forces on the submunition grenade cause the slider assembly to slide into the armed position, aligning the detonator with the firing pin. Once aligned, a catch locks the slider in place such that upon appropriate impact, such as an impact with a hard surface, the firing pin is driven forward to strike the appropriately aligned detonator, detonating it, thereby igniting the warhead of the submunition grenade.

Like all mechanical systems, such slider assemblies are not fail-safe. Occasionally, they do not retract, or do not retract fully. This can happen, for example, when the striker assembly is locked for some reason.

One disadvantage of the prior art submunition fuzes described above, is that where the submunition grenade impacts with an inappropriate surface, such as a soft surface, or where the angle of impact is wrong, such that the firing pin is not induced to strike the detonator, the grenade is not detonated. Consequently, there is a risk of armed submunition grenades launched at the enemy but not detonated on impact being left scattered over the battlefield. Wherever a submunition grenade does not detonate it is considered as being a "dud". Armed dud submunition grenades remain dangerous, and pose a risk to friendly troops and even to civilians long after the battle.

Submunition grenade fuzes are known that have a locked safe position for the firing pin that is designed to prevent the firing pin from being moved to the armed position inadvertently. When the grenades are packed into a cargo projectile carrier, the firing pin of each grenade fuze is unlocked, but it remains in its safe position until the fuze is armed. This only happens after the submunition grenade is ejected from the cargo projectile. In a submunition grenade of this type, one end of the shaft of the firing pin protrudes outside the fuze housing, and to the protruding end a drag producing means is fitted. The cargo projectile warhead spins in flight due to rifling of the barrel of the gun from which it is launched. When the grenades are ejected from the cargo projectile, the drag producing means, typically a nylon ribbon is activated.

This drag producing means acts in an inertial manner, countering the spin of the submunition grenade around its longitudinal axis, and displaces the firing pin assembly, causing it to assume a striking position. In his manner, the fuze is armed automatically, but only after ejection. On impact, the firing pin assembly is driven into the grenade with a force that causes the detonation of the fuze detonator and explosion of the warhead thereby.

In certain scenarios, the submunitions may be accidentally ejected from the assembled round due to nearby explosions, fire or other similar events. Following such accidents, the submunitions is usually armed, posing a very serious safety problem.

Thus, despite the many safety features included in submunition grenades (see for example U.S. Pat. No. 5,387,257 by M. Tari, et al., U.S. Pat. Nos. 6,142,080 and 6,145,439 by R. T. Ziemba, U.S. Pat. No. 6,244,184 by O. Tadmor, and U.S. Pat. No. 7,168,367 by A. Levy, et al.), there is still a risk of armed submunition grenades being dispersed over the battlefield but not detonated.

A need therefore exists for power source and safety mechanisms for secondary electrically operated self-destruct fuzes for submunitions that function in the event a mechanical or other primary fuze mode fails to function.

A need also exists for power sources that are not based on chemical batteries, including reserve batteries, that are cost effective and easy to mass produce and that provide for very long shelf life of sometimes over 20 years.

Furthermore, a need exists for power sources that are simple in design and operation, thereby are easy to manufacture and perform quality control to ensure reliability and long shelf life.

Furthermore, a need exists for power sources with essentially zero stored power, whether chemical or mechanical or electrical or in any other forms before the projectile firing while the submunitions and/or the cargo projectile packed with the submunitions are in storage.

Furthermore, a need exists for power sources and safety mechanisms that differentiate accidental acceleration profiles from those that are encountered during projectile firing and can also be during submunitions expulsion from the cargo projectile.

The present invention provides a method for the development of such power sources with integrated mechanisms to provide for the aforementioned safety requirements. In addition, a number of exemplary embodiments for such power sources with integrated safety mechanisms are disclosed.

The present invention relates generally to power source and safety mechanisms for munitions. In particular, it relates to secondary electrically operated self-destruct fuze for submunitions that function in the event a mechanical or other primary fuze mode fails to function.

An objective of the present invention is to significantly reduce the number of hazardous duds in the battlefield, thereby improving battlefield safety conditions for friendly troops passing through a former targeted area and for civilians after the battle.

A further objective of the present invention is to improve the life/cost saving in explosive ordnance disposal procedures.

A further objective of the present invention is to significantly reduce the cost of power sources in electrically operated fuzing in general and in self-destruct secondary fuzes in particular.

A further objective of the present invention is to reduce the complexity of the design, manufacture and testing and quality control of power sources in electrically operated fuzing in general and in self-destruct secondary fuzes in particular, thereby providing power sources that are more reliable.

A further objective of the present invention is to provide power sources that are less susceptible to environmental conditions such as corrosion, thereby could satisfy very long shelf life of sometimes over 20 years.

A further objective of the present invention is to provide a power source for self-destruct fuzes that have essentially zero electrical and/or mechanical and/or chemical and/or other types of stored energy prior to the projectile launch and that energy, mechanical and/or electrical is generated at least partially due to the firing acceleration.

A further objective of the present invention is to provide power sources with primary safety mechanisms that would allow them to initiate power generation essentially only if the projectile experiences an acceleration profile that is expected during the firing or a specified acceleration profile.

It is yet another objective of the present invention to provide power sources with secondary safety mechanisms for use in self-destruct fuzes for submunitions that would essentially prevent power generation only if the projectile experiences an acceleration profile that is expected during the firing (or a specified acceleration profile) and then experiences an acceleration profile due to the detonation of the submunitions expulsion charges.

Another objective of the present invention is to remove a source of (duds) booby trap application by an enemy.

SUMMARY

Accordingly, a method is provided for the development of power sources for self-destruct fuzes for submunition with substantially zero power prior to projectile firing, or prior to projectile firing and post projectile firing until submunitions expulsion from the projectile. The aforementioned zero power characteristics is to ensure safe handling and storage during various stages of submunitions production and assembly into the cargo projectile as well as storage of the projectile. The indicated safety features can be integrated into the design of the power source.

In addition, a number of embodiments for such power sources with integrated safety mechanisms are provided.

BRIEF DESCRIPTIONS OF THE DRAWINGS

These and other features, aspects, and advantages of the apparatus and methods of the present invention will become better understood with regard to the following description, appended claims, and accompanying drawings where:

FIG. 1 illustrates a typical volume available in submunitions for a power source and safety mechanisms.

FIG. 2 illustrates a first embodiment of a power source with integrated safety mechanism for submunitions.

DETAILED DESCRIPTION

Figure 3:
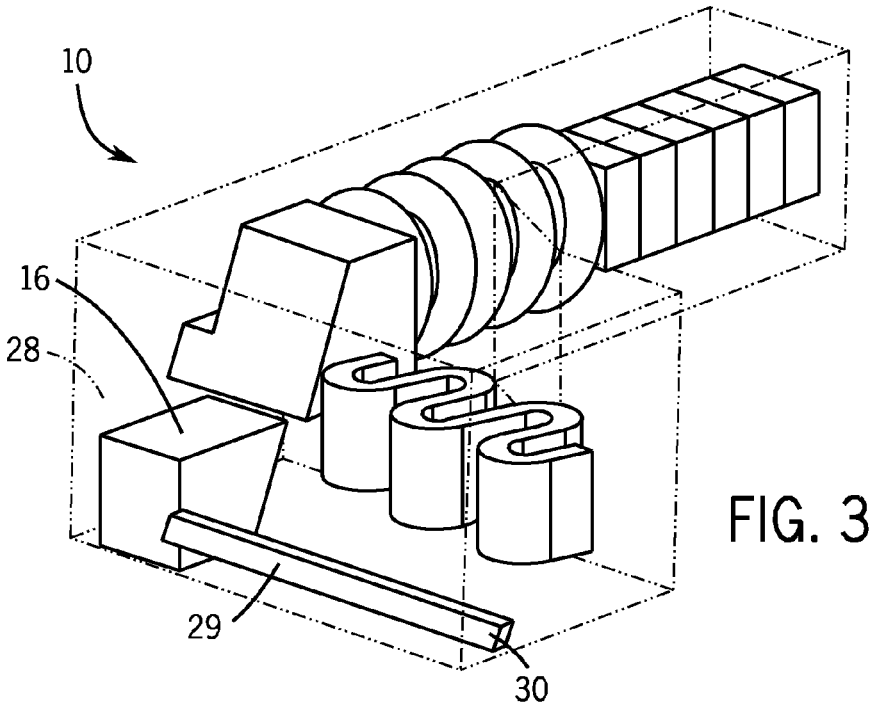
FIG. 3 illustrates the power source of FIG. 3 after experiencing an acceleration of a predetermined magnitude to activate the power source into a power generating configuration.

In general, the amount of space available for power sources and for the aforementioned safety mechanisms in submunitions self-destruct fuze is very small, making the use of chemical reserve batteries very difficult and costly, and nearly impractical. The use of active chemical batteries is not possible in submunitions due to the up to 20 years of shelf life requirement and also due to safety concerns that an active battery would generate. A typical volume available for a power source and its safety mechanisms is shown in FIG. 1 together with typical dimensions of this available space (see for example U.S. Pat. No. 5,387,257 by M. Tari, et al.). As can be observed, the available volume is very small and in many cases is a complex shape.

A method and apparatus are provided for power sources that could be designed to fit inside the available volume of the geometrical shape shown in FIG. 1 or other similarly complex shapes. In one embodiment, the power sources have substantially zero power prior to firing and begin to generate power after the projectile has been fired. In another embodiment, the power sources have substantially zero power prior to firing, post projectile firing until submunitions expulsion from the projectile has occurred.

In this method, the firing acceleration is used to deform at least one elastic element, thereby causing mechanical energy be stored in the at least one elastic element. In one embodiment, the stored mechanical energy causes vibration of the elastic element coupled with certain inertial elements, which may be integral to the elastic element. The mechanical energy is then harvested from the vibration system and converted into electrical energy using piezoelectric materials based elements. The harvested electrical energy is then used directly by the self-destruct fuze electrical/electronic circuitry and/or stored in electrical energy storage devices such as capacitors for use in said electrical/electronic circuitry and for detonation of self-destruct fuze charges. In another embodiment, the aforementioned deformed at least one elastic element (and its accompanying inertial element) is locked in its deformed position by certain mechanical locking mechanism and released only by the expulsion acceleration caused by the detonation of charges onboard the projectile during the flight. Once the at least one elastic element and its accompanying inertial element are released, the mechanical energy stored in the said elastic elements is harvested as described above for the previous embodiment.

As a result, the aforementioned power sources have zero power prior to firing (or prior to firing and prior to expulsion). These characteristics of the power sources ensure safe handling and storage during various stages of submunitions production and assembly into the cargo projectile as well as storage of the projectile and accidental expulsion of the assembled submunitions from the stored projectile. It is noted that the aforementioned safety features are integrated into the design of the power source, which may also be supplemented by other electrical/electronic safety features/logics, etc., to provide for additional safety.

The schematic of the first embodiment 10 of the power source with integrated safety mechanism is shown in FIG. 2. The power source 10 is positioned within the available space 5. The power source consists of an element mass 15, to which is attached at least one (primary) spring 12. In the schematic of FIG. 2 a second spring element 14 is also shown to be attached to one side of the mass element 15. The spring 14 is designed for primarily lateral deformation to allow the motion of the mass element 15 in the direction of the arrow 25, which is the primary direction of deformation (axial deformation in the case of the helical spring 12 shown in the schematic of FIG. 2) of the primary spring 12. It is noted that the mass element 15 and the primary spring 12 (and the spring 14, when present) may be integral. In addition, the spring 12 may be an elastic element of an appropriate shape to provide the required deformation to displacement (spring rate) in the direction of deformation as indicated by the arrow 25.

During the projectile firing, the direction of acceleration action on the power source is in the direction of the arrow 26. During the expulsion, the firing charge onboard the projectile accelerates the submunitions out of the back of the projectile, with the direction of the acceleration acting on the power source being in the direction opposite to the direction of the arrow 26.

The mass element 15 is attached to the primary spring 12. The opposite end of the primary spring 12 is then attached to at least one piezoelectric element 11 (which can be a stacked type of piezoelectric element). The piezoelectric element is in turn attached to the submunitions self-destruct fuze structure at the surface 17 (the self-destruct fuze structure not shown in FIG. 2).

The mass element 15 is provided with a sloped surface 24, which is engaged with a matching surface 27 of the element 16. The element 16 is positioned between the mass element 15 on one side (at its sloped surface 27) and the surface 21 of the submunitions self-destruct fuze structure, with which it is in contact with the surface indicated as 22. The element 16 is constrained to motions that are essentially in the direction of the arrow 26 which is provided by either guide on the surface 21 of the submunitions self-destruct fuze structure (not shown for clarity), or by the use of elastic elements (flexures) that provides such guided motions, or other means that are well known in the art. The element 16 may also be provided by elastic elements (such as of the bending type), not shown in FIG. 2, that provides a bias force that keeps pushing the element 16 downward (in the opposite direction to the arrow 26), pushing the sloped surface 27 of the element 16 against the sloped surface 24 of the mass element 15.

While a projectile that houses the submunitions with the self-destruct fuze with the present power sources are being fired, the entire submunitions self-destruct fuze assembly is accelerated in the direction of the arrow 26 in the gun barrel. During this period, the firing acceleration will act on the mass of the element 16 and causes it to be pushed down (in a direction opposite that of the applied acceleration, i.e., in a direction opposite to the direction of the arrow 26). This force, if large enough, will overcome the force exerted by any biasing force provided by the aforementioned biasing (such as of the bending type) elastic elements and frictional forces, springs 12 and 14 (if any) and will begin to move downward, thereby causing the mass element 15 to move to the right, thereby deforming the spring 12 in compression. If other elastic elements such as the element 14 shown in FIG. 2 are also present, they would also deform in their designed manner (in the case of the elastic element 14 in bending) and store additional potential energy. The aforementioned biasing forces (particularly those provided by the aforementioned elastic biasing element of the element 16 and the springs 12 and 14) can be designed to minimize the aforementioned motion of the element 16 as a result of accidental events such as dropping of the device or round or vibration and shock during transportation or the like.

If the acceleration level is high and long enough, which it is when the projectile is fired by a gun, then the element 16 is pushed down past the mass 15 and is pushed to the bottom of the available submunitions self-destruct fuze structure space 5 into the position indicated as 28 in the schematic of FIG. 3.

The mass element 15 and the spring 12 (and other elastic elements such as the element 14—if present) assembly will then begin to vibrate. During each cycle of this mass-spring assembly vibration, the primary spring 12 applies a cycle of compressive and tensile forces on the piezoelectric element 11. The force applied to the piezoelectric element would then generate a charge proportional to the applied force by the spring 12 (cyclic with the frequency of vibration of the aforementioned mass-spring assembly) in the piezoelectric element that is then harvested using a number of well known techniques and used directly in the self-destruct fuze circuitry or stored in a capacitor for later use.

If the acceleration level is not high and/or long enough, such as may occur if the submunitions or its self-destruct fuze is accidentally dropped, or if the assembled projectile itself is dropped, or if the submunitions are accidentally or due to a nearby explosion expelled from the projectile, then the force acting downward on the element 16 is either not large enough or is not applied long enough to cause the element 16 to be pushed down past the mass 15 and free the mass 15 and primary spring 12 (and other elastic elements such as the element 14—if present) assembly to begin to vibrate. This feature provides for safe operation of the submunitions self-destruct fuze, i.e., essentially zero power prior to firing of the projectile. It is noted that the (generally small amounts of) pressure exerted on the piezoelectric element 11 during the aforementioned events as the element 16 is pushed down slightly would still generate a small and short duration pulse of charges, which can be readily differentiated from the charges generated during the vibration of the mass-spring (elements 15 and 12—and 14 if present) assembly. A number of such methods of differentiating short duration (pulse) charges from vibratory charges and or differentiating the maximum (peak) voltage levels reached as the element 16 passes the mass 15 during projectile firing, or by measuring the total amount of electrical energy harvested (e.g., by measuring the voltage of a capacitor that is charged by the harvested electrical energy and providing a small amount of leakage to prevent the charges to be accumulated over a relatively long period of time), or the like are available and well known in the art.

It is also noted that once the element 16 has been pushed down to the position 28, FIG. 3, the biasing force provided by the aforementioned biasing (such as of the bending type) elastic elements (indicated as the element 29 in FIG. 3), will hold it down in its position 28, thereby prevent it from interfering with the vibration of the mass 15 and spring 12 (and spring 14—if present) assembly. In FIG. 3, the biasing elastic element 29 is shown to be of a bending type, which is attached to the element 16 on one end and to the submunitions self-destruct fuze structure at the point 30. Other types of elastic elements may also be used instead of the bending type 29 shown in FIG. 3. The biasing element 29 may also behave elastically while the element 16 is engaged with the mass element 15 and once it has moved down past the mass element 15, it enters its plastically deforming range and thereby is forced to stay substantially in its position 28. The biasing elastic element 29 may be integral to the element 16.

In another embodiment, a "latching" element (not shown in FIG. 3) is provided on the structure of the submunitions self-destruct fuze to which the biasing elastic (with or without plastically deforming characteristic) is locked once it nears its position 28, and is thereby prevented from returning to its original position shown in FIG. 2 or interfering with the vibration of the mass element 16. It is noted that locking latching elements are very well known in the art and is used extensively to lock various components together, particularly components made with relatively elastic materials such as plastics.

It is also noted that the piezoelectric element 11 can be preloaded in compression. This is a well known method of using piezoelectric elements since piezoelectric ceramics are highly brittle and can only withstand low levels of tensile forces. Preloading of the piezoelectric element 11 can be made, for example, by either the spring 14 or by adding a separate spring that is fixed to the submunitions self-destruct fuze structure and presses on the piezoelectric element 11 at its free end (not shown), where it is attached to the primary spring 12. Any other method commonly used in the art may also be used to preload the piezoelectric element in compression. The amount of preload can be to a level that prevents the piezoelectric element to be subjected to tensile loading beyond its tensile strength, for example not more than around 10 percent of its compressive strength.

Figure 4:
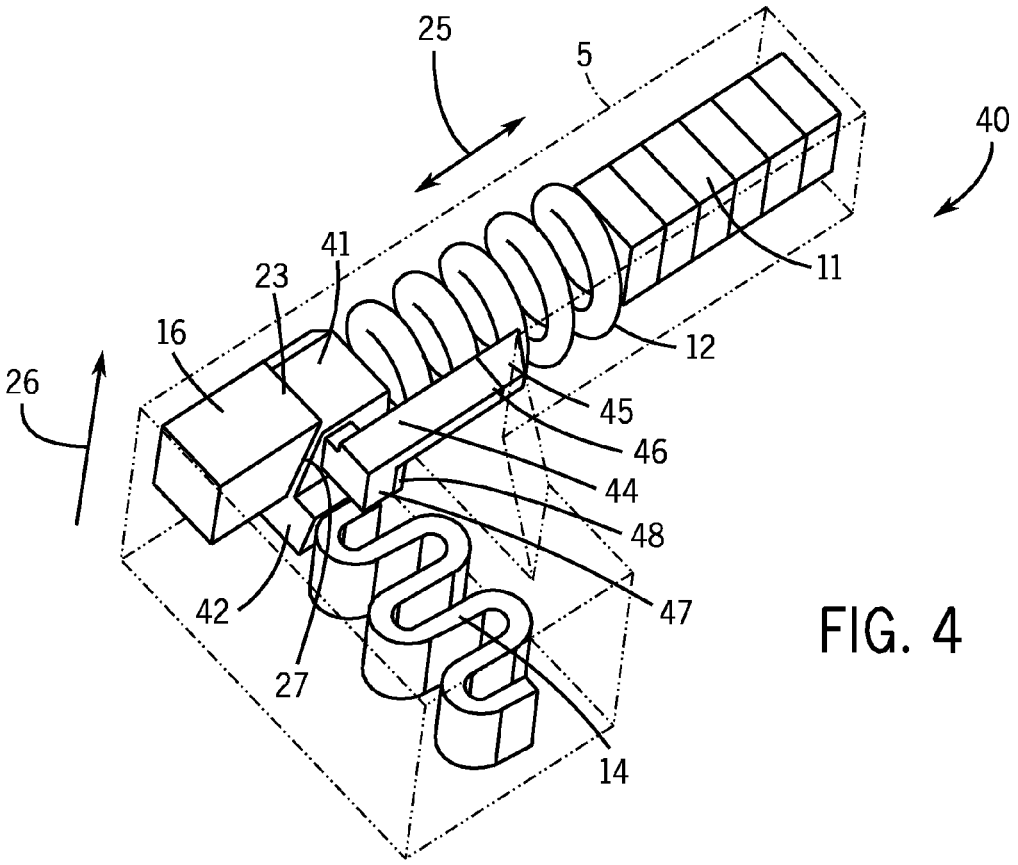
FIG. 4 illustrates a second embodiment of a power source with integrated safety mechanism for submunitions.

The schematic of another embodiment 40 of the power source with integrated safety mechanism is shown in FIG. 4. The embodiment 40 has all the components described for the embodiment 10 shown in FIGS. 2 and 3, with the following additional features.

The power source 40 has an additional member 44, which can be in the form of a beam that is fixed to the submunitions self-destruct fuze structure at the point 45 via a hinge joint 46, which can be a living joint, that allows the member 44 to rotate upwards and downwards in the direction of the arrow 26. The free end of the member 44 is provided with a downward bended portion 47. The mass element 41 in turn is provided with a step 48 that could engage the bended portion 47 of the member 44 if the mass element 41 and the member 44 are both appropriately positioned. Similar to the embodiment 10 shown in FIGS. 2 and 3, the mass element 41 is also provided with a sloped surface 42, which is engaged with a matching surface 27 of the element 16.

While a projectile that houses the submunitions with the self-destruct fuze with the present power sources are being fired, the entire submunitions self-destruct fuze assembly is accelerated in the direction of the arrow 26 in the gun barrel.

Figure 5:
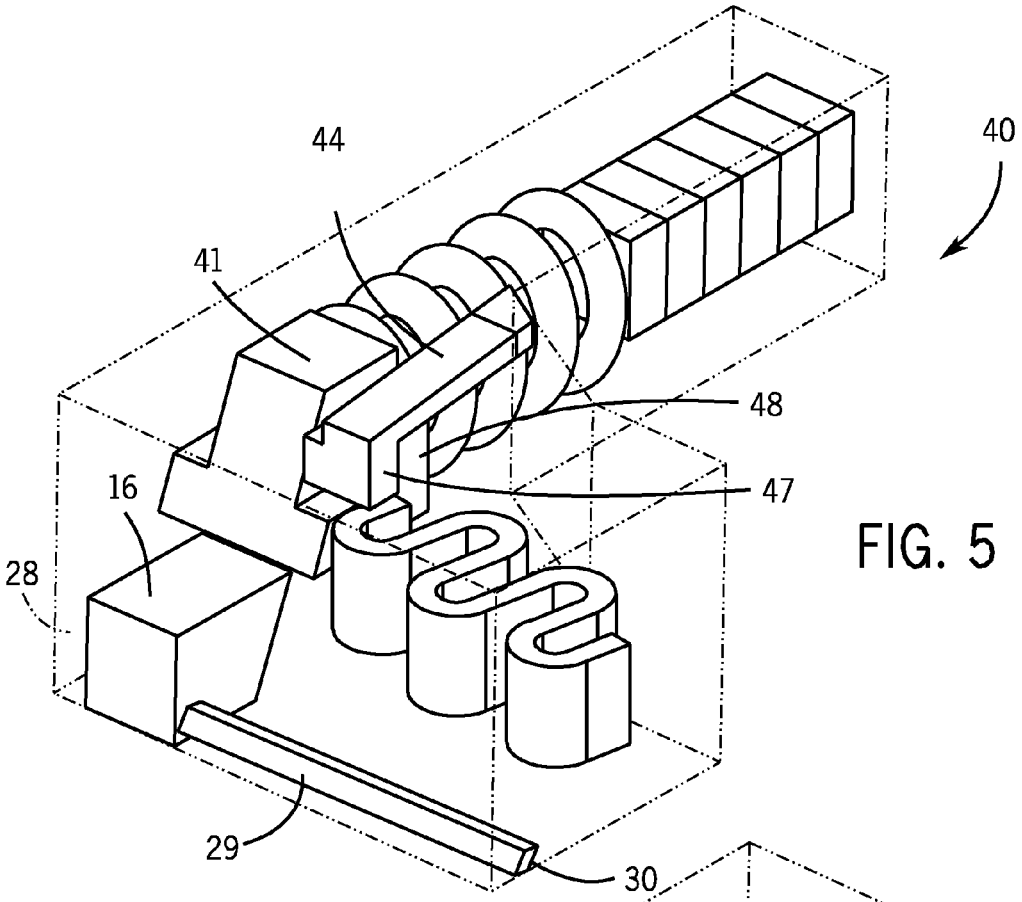
FIG. 5 illustrates the power source of FIG. 4 after experiencing an acceleration of a first predetermined magnitude and/or direction to activate the power source into an intermediate position.

During the projectile firing, the direction of acceleration action on the power source is in the direction of the arrow 26. During the expulsion, the firing charge onboard the projectile accelerates the submunitions out of the back of the projectile, with the direction of the acceleration acting on the power source being in the direction opposite to the direction of the arrow 26. During the firing, the firing acceleration will act on the mass of the element 16 and causes it to be pushed down (in a direction opposite that of the applied acceleration, i.e., in a direction opposite to the direction of the arrow 26). The force resulting from the firing acceleration and acting on the element 16 will then overcome the force exerted by any biasing force provided by the aforementioned biasing (such as of the bending type) elastic elements 29 (shown in FIG. 5 but not shown in FIG. 4 for clarity), frictional forces, and spring 12 (and spring 14—if present) and will begin to move the element 16 downward, thereby causing the mass element 41 to move to the right, thereby deforming the spring 12 in compression. If other elastic elements such as the element 14 shown in FIG. 2 are also present, they would also deform in their designed manner (in the case of the elastic element 14 in bending) and store additional potential energy. If the acceleration level is high and long enough, which it is when the projectile is fired by a gun, then the element 16 is pushed down past the mass element 41 and is moved to the bottom of the available submunitions self-destruct fuze structure space 5 into the position indicated as 28 in the schematic of FIG. 5.

The element 16 is then held in its position 28 by the element 29 as was described for the embodiment of FIGS. 2 and 3. In the meantime, as the mass element 41 is pushed back enough by the element 16 during its downward motion, the downward bended portion 47 of the element 44 engages the step 48 of the mass element 41, and as the element 16 passes the mass element 41 towards its position 28, the mass element 41 is prevented from rebounding to its original position (FIG. 4) by the force of the compressed spring 12 (and spring 14—if provided).

If the acceleration level is not high and/or long enough, such as may occur if the submunitions or its self-destruct fuze is accidentally dropped, or if the assembled projectile itself is dropped, or if the submunitions are accidentally or due to a nearby explosion expelled from the projectile, then the force acting downward on the element 16 is either not large enough or is not applied long enough to cause the element 16 to be pushed down past the mass 41. This feature provides for safe operation of the submunitions self-destruct fuze, i.e., essentially zero power prior to firing of the projectile. It is noted that the (generally small amounts of) pressure exerted on the piezoelectric element 11 during the aforementioned events as the element 16 is pushed down slightly would still generate a small and short duration pulse of charges. These events are, however, readily differentiated from the charges generated during the vibration of the mass-spring (elements 41 and 12—and 14 if present) assembly. A number of such methods of differentiating short duration (pulse) charges from vibratory charges and or differentiating the maximum (peak) voltage levels reached as the element 16 passes the mass element 41 during projectile firing, or by measuring the total amount of electrical energy harvested (e.g., by measuring the voltage of a capacitor that is charged by the harvested electrical energy and providing a small amount of leakage to prevent the charges to be accumulated over a relatively long period of time), or the like are available and well known in the art may be employed for this purpose.

Figure 6:
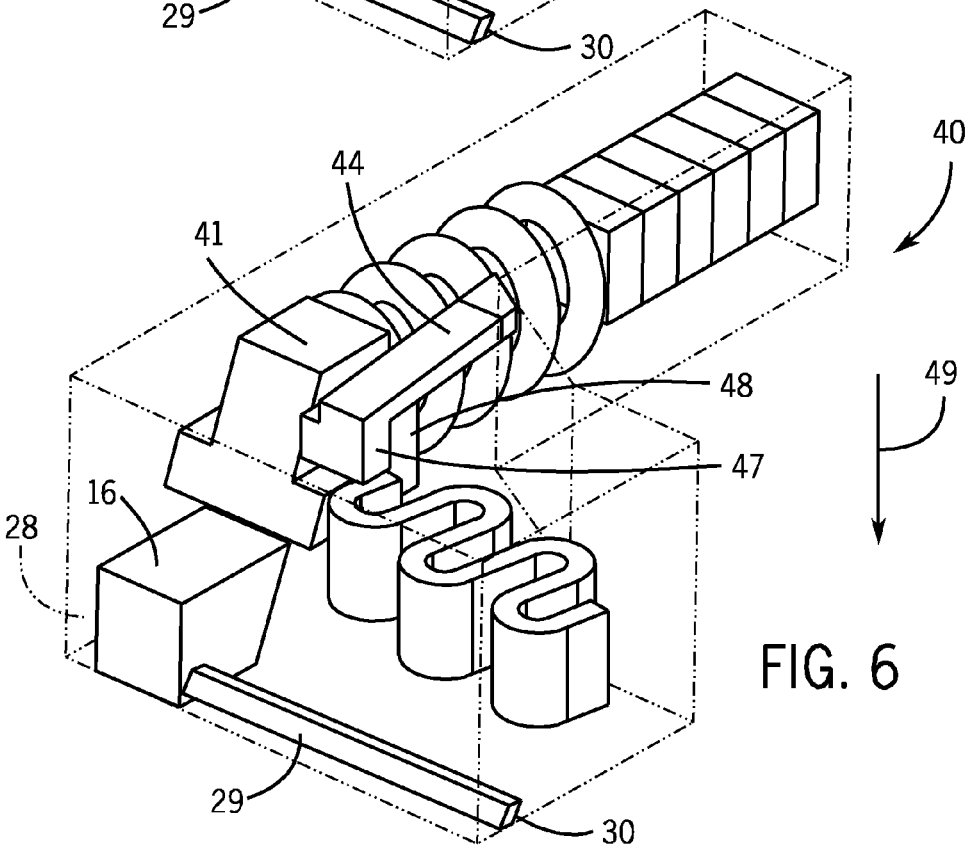
FIG. 6 illustrates the power source of FIG. 4 after experiencing an acceleration of a second predetermined magnitude and/or direction to activate the power source into a power generating configuration.

At some point during the projectile flight, submunitions expulsion charges are detonated, and the submunitions are accelerated out of the back of the projectile in the direction shown by the arrow 49 as shown in FIG. 6, which is in a direction opposite to the projectile firing acceleration as indicated by the arrow 26 in FIG. 4. The expulsion acceleration of the submunitions in the direction of the arrow 49 will then act on the mass (inertia) of the member 44, causing it rotate upwards, thereby releasing the mass element 41. The mass element 41 and the spring 12 (and other elastic elements such as the element 14—if present) assembly will then begin to vibrate. During each cycle of this mass-spring assembly, the primary spring 12 applies a cycle of compressive and tensile forces on the piezoelectric element 11. The force applied to the piezoelectric element would then generate a charge proportional to the applied force by the spring 12 (cyclic with the frequency of vibration of the aforementioned mass-spring assembly) in the piezoelectric element that is then harvested using a number of well known techniques and used directly in the self-destruct fuze circuitry or stored in a capacitor for later use.

The positioning of the member 44 can be biased downward, which can be by the living joint 46 and its own beam-like member, such that while its downward bent portion 47 is engaged with the step 48 of the mass element 41, incidental accelerations in the direction of the arrow 49, FIG. 6, or incidental decelerations in the direction of the arrow 26, FIG. 4, would not cause the member 44 to release the mass element 41.

It is noted that in many projectiles, the projectiles are accelerated in rotation during the firing using rifled barrels to achieve a desired spinning rate upon exit to achieve stability during the flight. In such cases, the spinning acceleration during the firing and the centrifugal forces generated due to the spinning speed of the projectile during the flight can also be considered when calculating the spring rates for the spring 12 (and the spring 14—if present) and their preloading levels for the proper operation of the power source and its safety features. The above factors can also be considered during the design of the remaining components of the power source and its safety mechanisms to ensure their proper operation.

While there has been shown and described what is considered to be preferred embodiments of the invention, it will, of course, be understood that various modifications and changes in form or detail could readily be made without departing from the spirit of the invention. It is therefore intended that the invention be not limited to the exact forms described and illustrated, but should be constructed to cover all modifications that may fall within the scope of the appended claims.

What is claimed is:

1. A method for providing electrical energy to a self-destruct fuze for submunitions contained in a projectile, the method comprising:

moving an element in a direction opposite to a direction of an acceleration of the projectile;

engaging the element at least indirectly with at least one elastic element to deform the at least one elastic element to store mechanical energy in the elastic element;

disengaging the element from the at least one elastic element when the acceleration is greater than a predetermined firing acceleration to convert the stored mechanical energy to kinetic energy;

converting the kinetic energy to electrical energy; and providing the electrical energy at least indirectly to the self destruct fuze for detonation of the self destruct fuze.

2. The method of claim 1, further comprising a mass connected to the at least one elastic element to form an elastic element and mass unit, the mass engaging the first element to deform the at least one elastic element, wherein the stored mechanical energy causes vibration of the elastic element and mass unit.

3. The method of claim 2, wherein the vibration of the elastic element mass unit applies a cyclic force to at least one piezoelectric element to produce the electric energy.

4. The method of claim 3, wherein the electric energy is conditioned prior to input into the self-destruct fuze electrical/electronic circuitry.

5. The method of claim 3, wherein the at least piezoelectric element produces substantially zero electrical energy prior to the firing acceleration and begins to generate the electrical energy after the projectile has been fired.

6. The method of claim 1, further comprising measuring the electrical energy and differentiating between the firing of the projectile and another unintended event which produces electrical energy based on the measured electrical energy.

7. The method of claim 6, wherein the electrical energy is not provided to the self destruct fuze if the differentiating determines the electrical energy produced is the result of the unintended event.

* * * * *